US005622772A

United States Patent [19]

Stokes et al.

[11] Patent Number: 5,622,772

[45] Date of Patent: Apr. 22, 1997

[54] HIGHLY CRIMPABLE SPUNBOND CONJUGATE FIBERS AND NONWOVEN WEBS MADE THEREFROM

[75] Inventors: Ty J. Stokes, Suwanee; Alan E. Wright, Woodstock; Simon K. Ofosu, Lilburn, all of Ga.

[73] Assignee: Kimberly-Clark Corporation, Neenah, Wis.

[21] Appl. No.: 508,644

[22] Filed: Jul. 28, 1995

Related U.S. Application Data

[63] Continuation-in-part of Ser. No. 253,876, Jun. 3, 1994, abandoned.

[51] Int. Cl.[6] ..... D03D 3/00

[52] U.S. Cl. ..... 442/401; 428/369; 428/373; 428/374

[58] Field of Search ..... 428/224, 288, 428/296, 297, 373, 374, 369

[56] References Cited

U.S. PATENT DOCUMENTS

| | | | |
|---|---|---|---|
| Re. 30,955 | 6/1982 | Stainstreet | 156/308.2 |
| 3,144,436 | 8/1964 | Greene et al. | 260/93.7 |
| 3,233,023 | 2/1966 | Benson | 264/168 |
| 3,399,259 | 8/1968 | Brayford | 264/168 |
| 3,423,266 | 1/1969 | Davies et al. | 156/167 |
| 3,491,178 | 1/1970 | Nishioka et al. | 264/168 |
| 3,577,498 | 5/1971 | Matsuo et al. | 264/168 |
| 3,589,956 | 6/1971 | Kraz et al. | 428/369 |
| 3,629,053 | 12/1971 | Kimura | 161/173 |
| 3,692,618 | 9/1972 | Dorschner et al. | 161/72 |
| 3,900,678 | 8/1975 | Aishima et al. | 428/374 |
| 4,115,620 | 9/1978 | Gupta et al. | 428/374 |
| 4,189,338 | 2/1980 | Ejima et al. | 156/167 |
| 4,234,655 | 11/1980 | Kunimune et al. | 428/374 |
| 4,285,748 | 8/1981 | Booker et al. | 428/288 |
| 4,315,881 | 2/1982 | Nakajima et al. | 264/171 |
| 4,323,626 | 4/1982 | Kunimune et al. | 428/374 |
| 4,340,563 | 7/1982 | Appel et al. | 264/518 |
| 4,424,257 | 1/1984 | Bach | 428/370 |
| 4,424,258 | 1/1984 | Bach | 428/370 |
| 4,469,540 | 9/1984 | Furukawa et al. | 156/62.4 |
| 4,500,384 | 2/1985 | Tomioka et al. | 156/290 |
| 4,814,032 | 3/1989 | Taniguchi et al. | 156/167 |
| 4,818,587 | 4/1989 | Ejima et al. | 428/198 |
| 4,981,749 | 1/1991 | Kubo et al. | 428/219 |
| 5,082,720 | 1/1992 | Hayes | 428/224 |
| 5,108,820 | 4/1992 | Kaneko et al. | 428/198 |
| 5,141,805 | 8/1992 | Nohara et al. | 428/296 |
| 5,213,881 | 5/1993 | Timmons et al. | 428/224 |
| 5,270,107 | 12/1993 | Gessner | 428/369 |
| 5,298,321 | 3/1994 | Isoda et al. | 428/228 |
| 5,352,518 | 10/1994 | Muramoto et al. | 428/373 |

FOREIGN PATENT DOCUMENTS

| | | |
|---|---|---|
| 0269051 | 6/1988 | European Pat. Off. . |
| 0395336 | 10/1990 | European Pat. Off. . |
| 0586924A1 | 3/1994 | European Pat. Off. . |
| 1442681 | 7/1976 | United Kingdom .' |

*Primary Examiner*—James J. Bell
*Attorney, Agent, or Firm*—Michael U. Lee

[57] ABSTRACT

The present invention provides conjugate fibers having an ethylene polymer component and a propylene polymer component, which are highly crimpable even at fine deniers. Also provided are nonwoven fabrics made from the fibers. The propylene polymer component of the conjugate fiber contains a propylene polymer having a melt flow rate between about 50 g/10 min. and 200 g/10 min. as measured in accordance with ASTM D1238, Testing Condition 230/2.16.

10 Claims, 6 Drawing Sheets

HIGHLY CRIMPABLE SPUNBOND CONJUGATE FIBERS AND NONWOVEN WEBS MADE THEREFROM

This application is a continuation-in-part application of application Ser. No. 08/253,876, filed Jun. 3, 1994 now abandoned.

BACKGROUND OF THE INVENTION

The present invention is related to conjugate spunbond fibers containing a high melt flow rate propylene polymer and to nonwoven webs produced therefrom.

Spunbond fibers are small diameter filaments or fibers that are formed by extruding or melt-spinning thermoplastic polymers as filaments from a plurality of capillaries of a spinneret. Unlike typical textile yarn and staple fiber production processes which mechanically draw spun filaments, in a spunbond fiber production process, extruded filaments are rapidly drawn while being cooled by a flow of pressurized air or by one of other well-known pneumatic drawing processes. The drawn filaments are deposited or laid onto a forming surface in a random, isotropic manner to form a loosely entangled fiber web, and then the laid fiber web is bonded to impart physical integrity and dimensional stability. The production of spunbond webs is disclosed, for example, in U.S. Pat. Nos. 4,340,563 to Appel et al.; 3,692,618 to Dorschner et al. and 3,802,817 to Matsuki et al. Spunbond fibers have relatively high molecular orientation, compared to other fibers produced with a pneumatic drawing process, e.g., meltblown fibers, and thus exhibit relatively high strength properties.

Conjugate fibers having two or more component polymers that are designed to benefit from combinations of desired chemical and/or physical properties of the component polymers are well known in the art. Methods for making conjugate fibers and fabrics produced therefrom are disclosed, for example, in U.S. Pat. Nos. 3,595,731 to Davies et al., Reissue 30,955 to Stanistreet and 5,418,045 to Pike et al., and European Patent Application 0 586 924. It is also known that nonwoven webs containing crimped conjugate fibers exhibit improved tactile properties, including bulk, softness and fullness. For example, U.S. Pat. No. 5,418,045 discloses a nonwoven fabric of crimped conjugate spunbond fibers that has highly desirable textural properties and improved fiber coverage. The patent teaches a spunbond nonwoven fabric production process that draws and thermally crimps conjugate spunbond fibers before the fibers are deposited to form a nonwoven fabric.

Although processes for thermally crimping conjugate fibers are known in the art, the process of thermally imparting crimps during the production process of the fibers becomes highly onerous as the average size (thickness) of fibers is reduced to produce fine denier fibers and/or the throughput, i.e., the amount of polymer processed through the spinneret, of component polymers for the conjugate fibers is increased to speed up the production. Consequently, attempts to produce small denier fibers and to increase the throughput or production rate tend to result in flat and dense nonwoven webs. This difficulty in imparting crimps is especially pronounced in the production of spunbond fibers since the pneumatic drawing step of a spunbond fiber production process, unlike a mechanical draw process, provides only a limited drawing force and does not draw the spun fibers with the high drawing ratio capabilities of a mechanical drawing process.

There remains a need for a process for producing highly crimped pneumatically drawn conjugate fibers that can impart high levels of crimps even for fine denier fibers and even at high speed production rates without requiring additional and onerous manufacturing steps.

SUMMARY OF THE INVENTION

The present invention provides a highly crimpable conjugate spunbond fiber comprising a propylene polymer component and an ethylene polymer component, wherein each of the components occupies a distinct section for substantially the entire length of the spunbond fiber. The propylene polymer component contains a propylene polymer having a melt flow rate between about 50 g/10 min. and 200 g/10 min. as measured in accordance with ASTM D1238, Testing Condition 230/2.16 and is selected from homopolymers and copolymers of propylene and blends thereof, and the ethylene polymer component contains an ethylene polymer which is selected from homopolymers and copolymers of ethylene. Additionally provided is a nonwoven web containing the conjugate spunbond fibers.

The present conjugate fibers are highly crimpable even at fine deniers, providing a soft, high loft nonwoven web. As such, the nonwoven webs produced from the conjugate fibers are highly useful as various parts for disposable articles, including diapers, sanitary napkins, incontinence products, wipes, cover materials, garment materials, filters and the like.

The term "conjugate fibers" refers to fibers containing at least two polymeric components which are arranged to occupy distinct sections for substantially the entire length of the fibers. The conjugate fibers are formed by simultaneously extruding at least two molten polymeric component compositions as a plurality of unitary multicomponent filaments or fibers from a plurality of capillaries of a spinneret. The term "fine denier fibers" refers to fibers having a weight-per-unit length of less than about 2.5 denier (2.8 dtex). The term "webs" as used herein refers to fibrous webs and fabrics.

DETAILED DESCRIPTION OF THE INVENTION

Figure 1:
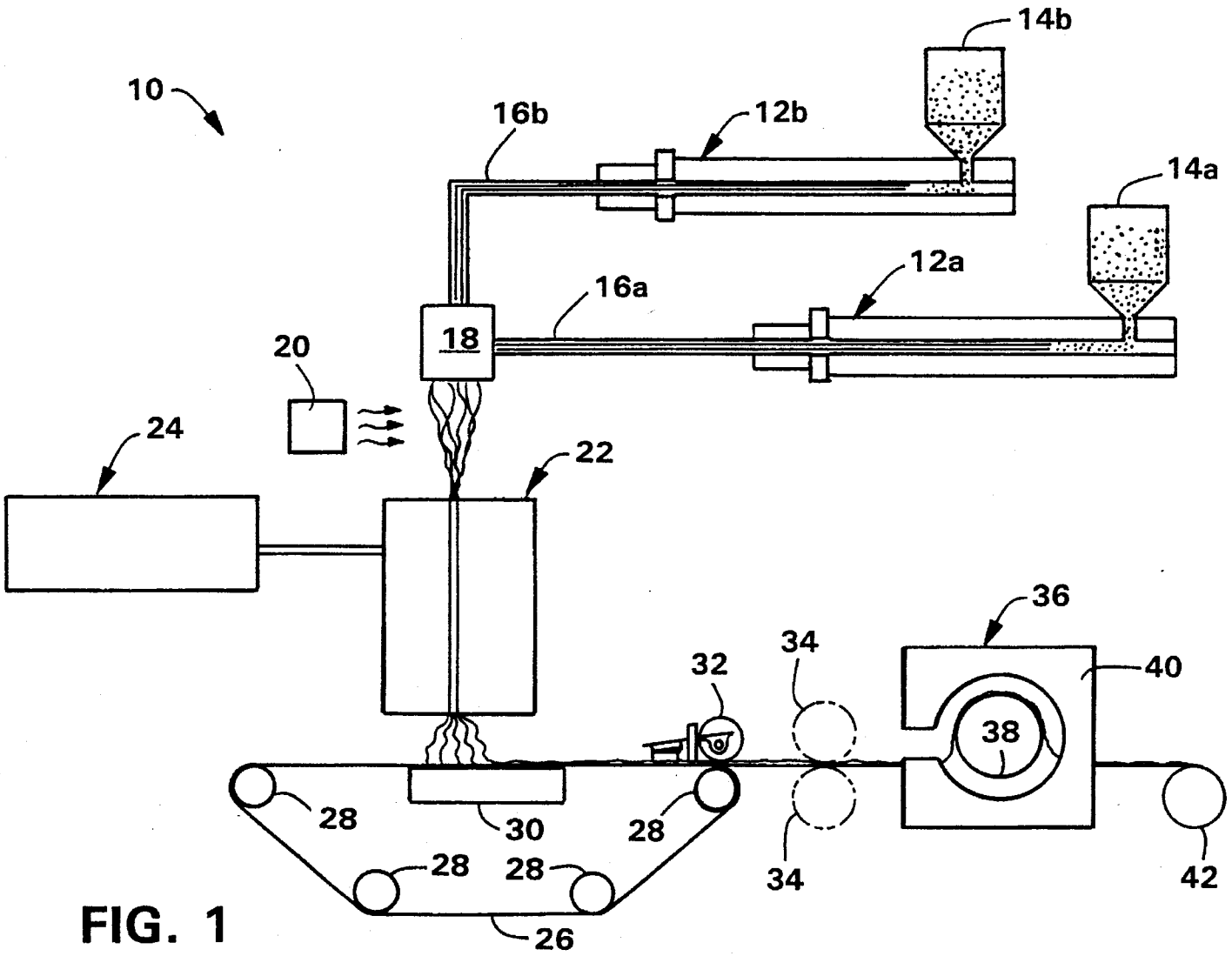
FIG. 1 illustrates a suitable process for producing the conjugate fiber and the nonwoven web of the invention.

The present invention provides highly crimpable conjugate spunbond fibers and highly crimped conjugate spunbond fibers produced therefrom. Additionally provided is a lofty or bulky spunbond nonwoven fiber web containing the crimped conjugate fibers. The present invention also provides a process for producing highly crimped conjugate spunbond fibers and lofty, low-density nonwoven fiber webs. The conjugate spunbond fibers can be produced to have a high level of crimps even at fine deniers and even when the fibers are produced at a high production rate.

The conjugate spunbond fibers of the present invention contain a propylene polymer component and an ethylene polymer component, although the conjugate fibers may contain additional polymer components that are selected from a wide variety of fiber-forming polymers. Desirably, the conjugate fibers contain from about 20 wt % to about 80 wt % of a propylene polymer and from about 80 wt % to about 20 wt % of an ethylene polymer, based on the total weight of the fibers.

In accordance with the invention, a suitable propylene polymer has a higher melt flow rate than propylene polymers conventionally used to produce spunbond fibers. A suitable propylene polymer for the present invention has a melt flow rate between about 50 g/10 minutes and about 200 g/10 minutes, more desirably between about 55 g/10 minutes and about 150 g/10 minutes, most desirably the melt flow rate is between about 60 g/10 minutes and about 125 g/10 minutes, as measured in accordance with ASTM D1238-90b, Test Condition 230/2.16, before the polymer is melt-processed.

It has surprisingly been found that the use of the high melt flow rate propylene polymer enhances crimpability of the conjugate spunbond fibers, improves the bulk of the nonwoven webs and enables the production of lower density nonwoven webs. Additionally, the use of the high melt flow rate propylene polymer enables the production of highly crimped fine denier conjugate fibers. Accordingly, the conjugate spunbond fibers web of the present invention can be produce to have highly improved properties, e.g., softness, uniform fiber coverage and hand. Furthermore, it has been found that the high melt flow rate propylene polymer composition can be melt-processed at a lower temperature than conventional propylene polymer for spunbond fibers.

Suitable propylene polymers for the present invention are homopolymers and copolymers of propylene, which include isotactic polypropylene, syndiotactic polypropylene and propylene copolymers containing minor amounts of one or more of other monomers that are known to be suitable for forming propylene copolymers, e.g., ethylene, butylene, methylacrylate-co-sodium allyl sulphonate, and styrene-co-styrene sulphonamide. Also suitable are blends of these polymers. Additionally suitable propylene polymers are the above-mentioned propylene polymers blended with a minor amount of ethylene alkyl acrylate, e.g., ethylene ethyl acrylate; polybutylene; and ethylene-vinyl acetate. Of these suitable propylene polymers, more desirable are isotactic polypropylene and propylene copolymers containing up to about 10 wt % of ethylene. As discussed above, the suitable propylene polymers have a melt flow rate higher than conventional polypropylenes for spunbond fibers. If the melt flow rate of the propylene polymer is lower than the above-specified range, it is difficult to produce highly crimped conjugate fibers of fine deniers with a conventional spunbond process at commercial speed, and if the melt flow rate is higher than the specified range, the physical incompatibility of the melted component polymer compositions may cause fiber-spinning difficulties and produce malformed fibers or fail the fiber-spinning process altogether.

Ethylene polymers suitable for the present invention are fiber-forming homopolymers of ethylene and copolymers of ethylene and one or more of comonomers, such as, butene, hexene, 4-methyl-1 pentene, octene, ethylenevinyl acetate and ethylene alkyl acrylate, e.g., ethylene ethyl acrylate. The suitable ethylene polymers may be blended with a minor amount of ethylene alkyl acrylate, e.g., ethylene ethyl acrylate; polybutylene; and/or ethylene-vinyl acetate. The more desirable ethylene polymers include high density polyethylene, linear low density polyethylene, medium density polyethylene, low density polyethylene and blends thereof; and the most desirable ethylene polymers are high density polyethylene and linear low density polyethylene.

As indicated above, the conjugate spunbond fibers of the invention may contain more than the propylene and ethylene polymer components. Fiber-forming polymers suitable for the additional polymer components of the present conjugate fibers include polyolefins, polyesters, polyamides, acetals, acrylic polymers, polyvinyl chloride, vinyl acetate-based polymer and the like, as well as blends thereof. Useful polyolefins include polyethylenes, e.g., high density polyethylene, medium density polyethylene, low density polyethylene and linear low density polyethylene; polypropylenes, e.g., isotactic polypropylene and syndiotactic polypropylene; polybutylenes, e.g., poly(1-butene) and poly(2-butene); polypentenes, e.g., poly(2-pentene), and poly(4-methyl-1-pentene); and blends thereof. Useful vinyl acetate-based polymers include polyvinyl acetate; ethylene-vinyl acetate; saponified polyvinyl acetate, i.e., polyvinyl alcohol; ethylene-vinyl alcohol and blends thereof. Useful polyamides include nylon 6, nylon 6/6, nylon 10, nylon 4/6, nylon 10/10, nylon 12, hydrophilic polyamide copolymers such as caprolactam and alkylene oxide diamine, e.g., ethylene oxide diamine, copolymers and hexamethylene adipamide and alkylene oxide copolymers, and blends thereof. Useful polyesters include polyethylene terephthalate, polybutylene terephthalate, and blends thereof. Acrylic polymers suitable for the present invention include ethylene acrylic acid, ethylene methacrylic acid, ethylene methyl methacrylate and the like as well as blends thereof. In addition, the polymer compositions of the conjugate fibers may further contain minor amounts of compatibilizing agents, colorants, pigments, optical brighteners, ultraviolet light stabilizers, antistatic agents, lubricants, abrasion resistance enhancing agents, crimp inducing agents, nucleating agents, fillers and other processing aids.

Suitable conjugate fibers for the present invention may have a side-by-side or sheath-core configuration. When a sheath-core configuration is utilized, an eccentric sheath-core configuration, i.e., non-concentrically aligned sheath and core, is desirable since concentric sheath-core fibers have a symmetrical geometry that tends to prevent thermal activation of crimps in the fibers. As is known in the art, crimps in the conjugate fibers can be imparted before, during or after the fibers are deposited or laid to form a nonwoven web. However, it is highly desirable to crimp the conjugate fibers before they are laid into a nonwoven web since the crimping process inherently causes shrinkage and dimensional changes. As is known in the art, such dimensional changes are difficult to manage and tend to adversely affect the uniformity and fiber coverage of the web. Therefore, it is highly advantageous to crimp the conjugate fibers before they are formed into a nonwoven web in order to provide a dimensionally stable web that has a uniform fiber coverage.

FIG. 1 illustrates an exemplary spunbond process 10 for producing a nonwoven conjugate spunbond fiber web, more specifically a bicomponent fiber web, of the present invention. The spunbond process is highly suitable for producing a lofty, low-density spunbond web. A pair of extruders **12*a* and 12*b* separately extrude the propylene polymer and ethylene polymer compositions, which compositions are separately fed into a first hopper 14*a* and a second hopper 14*b*, to simultaneously supply molten polymeric compositions to a spinneret 18. Suitable spinnerets for extruding conjugate fibers are well known in the art. Briefly, the spinneret 18** has a housing which contains a spin pack, and the spin pack contains a plurality of plates and dies. The plates have a pattern of openings arranged to create flow paths for directing the two polymers to the dies that have one or more rows of openings, which are designed in accordance with the desired configuration of the resulting conjugate fibers.

As indicated above, the melt-processing temperature of the polymer compositions for the present conjugate fibers is lower than conventional processing temperatures for conventional polypropylene utilized for spunbond fibers.

The ability to process the polymer composition at a lower temperature is highly advantageous in that the lower processing temperature, for example, decreases the chance of thermal degradation of the component polymers and other additives, and lessens the problems associated with quenching the spun filaments, e.g., roping of the spun filaments, in addition to reducing energy requirements.

The spinneret 18 provides a curtain of conjugate filaments or continuous fibers, and the continuous fibers are quenched by a quench air blower 20 before being fed into a fiber draw unit, or an aspirator, 22. The disparate heat shrinkage of the component polymers of the quenched conjugate fibers imparts latent crimpability in the fibers, which can be heat activated. Suitable pneumatic fiber draw units or aspirators for use in melt spinning polymers are well known in the art, and particularly suitable fiber draw units for the present invention include linear fiber aspirators of the type disclosed in U.S. Pat. No. 3,802,817 to Matsuki et al., which in its entirety is incorporated by reference. Briefly, the fiber draw unit 22 includes an elongate vertical passage through which the filaments are drawn by aspirating air entering from the side of the passage. The aspirating air, which is supplied from a compressed air source 24, draws the filaments and imparts molecular orientation in the filaments. In addition to drawing the filaments, the aspirating air can be used to impart crimps in, more specifically to activate the latent crimp of, the filaments.

In accordance with the present invention, the temperature of the aspirating air supplied from the air source 24 is elevated by a heater such that the heated air heats the filaments to a temperature that is sufficiently high enough to activate the latent crimp. The temperature of the drawing air can be varied to achieve different levels of crimps. In general, a higher air temperature produces a higher level of crimps. Consequently, by changing the temperature of the aspirating air, fibers having different levels of crimps can be conveniently produced.

The process line 10 further includes an endless foraminous forming surface 26 which is placed below the draw unit 22 and is driven by driver rollers 28 and positioned below the fiber draw unit 22. The drawn filaments exiting the fiber draw unit are isotropically deposited onto the forming surface 26 to form a nonwoven web of uniform thickness and fiber coverage. The fiber depositing process can be better facilitated by placing a vacuum apparatus 30 directly below the forming surface 26 where the fibers are being deposited. The above-described simultaneous drawing and crimping process is highly useful for producing lofty spunbond webs that have uniform fiber coverage and uniform web caliper. The simultaneous process forms a nonwoven web by isotropically depositing fully crimped filaments, and thus, the process produces a dimensionally stabilized nonwoven web. The simultaneous process in conjunction with the high melt flow rate propylene polymer is highly suitable for producing highly crimped fine denier conjugate fibers of the present invention.

The deposited nonwoven web is then bonded, for example, with a through air bonding process. Generally described, a through air bonder 36 includes a perforated roller 38, which receives the web, and a hood 40 surrounding the perforated roller. Heated air, which is sufficiently high enough to melt the lower melting component polymer of the conjugate fiber, is supplied to the web through the perforated roller 38 and withdrawn by the hood 40. The heated air melts the lower melting polymer and the melted polymer forms interfiber bonds throughout the web, especially at the cross-over contact points of the fibers. Through air bonding processes are particularly suitable for producing a lofty, uniformly bonded spunbond web since these processes uniformly effect interfiber bonds without applying significant compacting pressure. Alternatively, the unbonded nonwoven web can be bonded with a calender bonder. A calender bonder is typically is an assembly of two or more of abuttingly placed heated rolls that forms a nip to apply a combination of heat and pressure to melt fuse the fibers of a thermoplastic nonwoven web, thereby effecting bonded regions or points in the web. The bonding rolls may be smooth to provide uniformly bonded nonwoven webs or contain a pattern of raised bond points to provide point bonded webs.

As discussed above, the present conjugate spunbond fibers containing the high melt flow rate propylene polymer provide high levels of crimps even at fine deniers and thus can be fabricated into lofty, low-density nonwoven webs of fine denier fibers even at high production rates. For example, the conjugate fibers can be processed to provide a fiber web having a bulk of at least about 20 mils per ounce per square yard (0.015 mm/g/m$^2$), as measured under a 0.025 psi (0.17 kPa) load, even when the size of the fibers is reduced to about 2.5 denier (2.8 dtex) or less, desirably to about 2 denier (2.2 dtex) or less, and more desirably to about 1.5 denier (1.7 dtex) or less. In addition, particularly desirable conjugate spunbond fiber webs for the invention have a density equal to or less than about 0.067 g/cm$^3$, more desirably between about 0.065 g/cm$^3$ and about 0.02 g/cm$^3$, and most desirably between about 0.055 g/cm$^3$ and about 0.025 g/cm$^3$.

The present lofty spunbond web or fabric provides improved softness, hand, drapability and cloth-like texture and appearance. The web is highly useful as an outer cover material for various disposable articles, e.g, diapers, training pants, incontinence-care articles, sanitary napkins, disposable garments and the like. The lofty spunbond web is also highly suitable as an outer layer of a barrier composite which provides a cloth-like texture in combination with other functional properties, e.g., fluid or microbial barrier properties. For example, the lofty spunbond web can be thermally or adhesively laminated onto a film or microfiber fabric in a conventional manner to form such barrier composites. U.S. Pat. No. 4,041,203 to Brock et al., for example, discloses a fabric-like composite containing a spunbond fiber web and a meltblown fiber web, which patent in its entirety is herein incorporated by reference. Disposable garments that can be produced from the present nonwoven fabrics include surgical gowns, laboratory gowns and the like. Such disposable garments are disclosed, for example, in U.S. Pat. Nos. 3,824,625 to Green and 3,911,499 to Benevento et al., which patents are herein incorporated by reference. In addition, the present lofty nonwoven web, especially a nonwoven web containing highly crimped fine denier conjugate spunbond fibers, that exhibits improved bulk and uniformity over conventional conjugate spunbond fiber webs, is highly useful for filtration applications since such fine fiber web provides uniformly distributed fine interfiber pores without sacrificing the loft of the web.

The following examples are provided for illustration purposes and the invention is not limited thereto.

EXAMPLES

Examples 1–2 (Ex1–Ex2)

Point bonded spunbond fiber webs of round side-by-side conjugate fibers containing 50 wt % linear low density polyethylene and 50 wt % polypropylene were produced using the process illustrated in FIG. 1. The bicomponent spinning pack had a 0.6 mm spinhole diameter, a 6:1 L/D ratio and a 50 holes/inch spinhole density. Linear low density polyethylene (LLDPE), Aspun 6811A, which is available from Dow Chemical, was blended with 2 wt % of a $TiO_2$ concentrate containing 50 wt % of $TiO_2$ and 50 wt % of polypropylene, and the mixture was fed into a first single screw extruder. The LLDPE composition was extruded to have a melt temperature of about 430° F. (221° C.) as the extrudate exits the extruder. Polypropylene, X11029-20-1, which has a melt flow rate (MFR) of about 65 g/10 min. at 230° C. under a 2.16 kg load and is available from Himont, was blended with 2 wt % of the above-described $TiO_2$ concentrate, and the mixture was fed into a second single screw extruder. The melt temperature of the polypropylene composition was kept at 430° F. (221° C.) for Example 1 and 465° F. (241° C.) for Example 2. The LLDPE and polypropylene extrudates were fed into the spinning pack which was kept at about 430° F. (221° C.), and the spinhole throughput rate was kept at 0.7 gram/hole/minute for Example 1 and 0.5 gram/hole/minute for Example 2. The bicomponent fibers exiting the spinning pack were quenched by a flow of air having a flow rate of 45 SCFM/inch (0.5 $m^3$/min/cm) spinneret width and a temperature of 65° F. (18° C.). The quenching air was applied about 5 inches (13 cm) below the spinneret. The quenched fibers were drawn and crimped in the aspirating unit using a flow of air heated to about 350° F. (177° C.) and supplied a pressure of 6.5 psi (45 kPa). Then, the drawn, crimped fibers were deposited onto a foraminous forming surface with the assist of a vacuum flow to form an unbonded fiber web. The unbonded fiber web was bonded by passing the web through the nip formed by two abuttingly placed bonding rolls, a smooth anvil roll and a patterned embossing roll. The raised bond points of the embossing roll covered about 15% of the total surface area and there were about 310 regularly spaced bond points per square inch. Both of the rolls were heated to about 250° F. (121° C.) and the pressure applied on the webs was about 100 lbs/linear inch (17.9 kg/cm) width. The bonded nonwoven webs, which had an average weight of about 1.0 ounce per square yard (34 g/$m^2$), were tested for their bulk and average fiber size. The crimp level of the fibers forming the nonwoven webs was indirectly measured by comparing the bulk of the webs since the bulk is directly correlated to the crimp level of the fibers, and the bulk is measured under a 0.025 psi (0.17 pKa) load. The results are shown in Table 1.

Comparative Examples 1–2 (C1–C2)

The procedure outlined for Examples 1 and 2 was repeated to produce Control 1–2, respectively, except Exxon PP3445 polypropylene was used. The polypropylene has a melt flow rate of about 35 g/min. at 230° C. and is a conventional fiber grade polypropylene. The results are shown in Table 1.

TABLE 1

| Example | PP MFR (g/10 min) | Throughput Rate (g/hole/min) | Fiber Size (den) | Fiber Size (dtex) | Bulk (mil) | Bulk (mm) | Density (g/$cm^3$) |
|---|---|---|---|---|---|---|---|
| Ex1 | 65 | 0.7 | 2.5 | 2.8 | 20.3 | 0.52 | 0.066 |
| C1 | 35 | 0.7 | 2.8 | 3.1 | 11.8 | 0.30 | 0.113 |
| Ex2 | 65 | 0.5 | 1.8 | 2.0 | 14.5 | 0.37 | 0.092 |
| C2 | 35 | 0.5 | 1.8 | 2.0 | 11.0 | 0.28 | 0.121 |

Note:
PP = polypropylene
MFR = melt flow rate
den = denier

The results demonstrate that the conjugate fibers containing a high melt flow polypropylene provide loftier and low-density nonwoven fabrics, clearly indicating that the fibers containing the high melt flow propylene polymer have a higher level of crimps than the conjugate fibers produced from a conventional spunbond fiber-forming fiber grade polypropylene. It is also to be noted that C1 and C2 exhibited similar bulk values even though the difference in the size of the fibers was highly significant, clearly illustrating the difficulty in thermally crimping fine denier fibers that are produced from conventional propylene polymers for spunbond fibers.

Examples 3–7 (Ex3–Ex7)

Unbonded nonwoven webs of side-by-side conjugate spunbond fibers were produced in accordance with the procedure outline in Example 1 using two different grades of polypropylene as indicated in Table 2, except the polymer throughput rate was kept at 0.7 g/hole/minute and the melt temperature of the two component polymer compositions was maintained at 430° F. (221° C.). In addition, the size of the fibers was controlled by changing the pressure of aspirating air as indicated in Table 2. Both 100 melt flow rate and 65 melt flow rate polypropylene resins were obtained from Shell Chemical.

The unbonded nonwoven webs were then bonded by passing the webs through a through-air bonder. The bonder exposed the nonwoven webs to a flow of heated air having a temperature of about 270° F. (132° C.) and a flow rate of about 200 feet/min (61 m/min). The average weight, fiber size and bulk of the bonded webs were measured, and the bulk was normalized to 1 osy (34 g/$m^2$). The results are shown in Table 2.

Comparative Examples 3–5 (C3–C5)

Example 3 was repeated except the polypropylene employed was the 35 melt flow rate polypropylene disclosed in Control 1. The results are shown in Table 2.

TABLE 2

| Example | PP MFR (g/10 min) | Aspirating Air Pressure (psi) | Aspirating Air Pressure (kPa) | Fiber Size (den) | Fiber Size (dtex) | Web Weight (osy) | Web Weight ($g/m^2$) | Bulk (mil/osy) | Bulk ($mm/g/m^2$) | Density ($g/cm^3$) |
|---|---|---|---|---|---|---|---|---|---|---|
| Ex3 | 100 | 4 | 28 | 2.0 | 2.2 | 2.03 | 69 | 36.5 | 0.0273 | 0.037 |
| Ex4 | 65 | 4 | 28 | 2.5 | 2.8 | 1.85 | 63 | 37.2 | 0.0279 | 0.036 |
| Ex5 | 100 | 5 | 34 | 1.9 | 2.1 | 1.89 | 64 | 37.4 | 0.0280 | 0.036 |
| C3 | 35 | 4 | 28 | 2.5 | 2.8 | 1.95 | 66 | 19.5 | 0.0146 | 0.068 |
| Ex6 | 100 | 6 | 41 | 1.8 | 2.0 | 1.94 | 66 | 23.7 | 0.0178 | 0.056 |
| Ex7 | 65 | 6 | 41 | 1.9 | 2.1 | 2.18 | 74 | 23.6 | 0.0177 | 0.057 |
| C4 | 35 | 5 | 34 | 2.2 | 2.4 | 2.03 | 69 | 14.5 | 0.0109 | 0.092 |
| C5 | 35 | 5.5 | 38 | 2.0 | 2.2 | 2.12 | 72 | 14.3 | 0.0107 | 0.093 |

The above results clearly demonstrate that utilizing a high melt flow propylene polymer significantly improves the bulk of the conjugate fiber webs and produces lower density nonwoven webs. For example, although the fibers of Example 4 and Control 3 had the same fiber size, the bulk of Example 4 was about 91% loftier than that of control 3. In addition, the low density and high bulk of the nonwoven webs of Examples 3–7, compared to those of the nonwoven webs of Comparative Examples 3–5, demonstrate that the conjugate fibers of the present invention have significantly higher levels of crimps over the conjugate fibers containing conventional propylene polymers for spunbond fibers.

Examples 8–11 (Ex8–Ex11)

Crimped conjugate fibers were produced in accordance with Example 1 except that the polymer compositions were processed at about 420° F. (216° C.) and the spinning pack was kept at 425° F. (218° C.). Additionally, different aspirating air pressures were applied to obtain conjugate spunbond filaments having different average sizes, as indicated in Table 3 below. The conjugate fibers were collected from the forming surface and studied under a microscope.

The filaments of Examples 8–11 are illustrated in FIGS. 2, 4, 6 and 8, respectively, as about 65 times magnified views of representative fibers.

Comparative Examples 6–9 (C6–C9)

Examples 8–11 were repeated for Comparative Examples 6–9, respectively, except a conventional polypropylene for spunbond fibers, Exxon PP3445 polypropylene, was used in place of the high melt flow rate polypropylene.

The filaments of Comparative Examples 6–9 are illustrated in FIGS. 3, 5, 7 and 9, respectively, as 65 times magnified views of representative fibers.

TABLE 3

Figure 2:
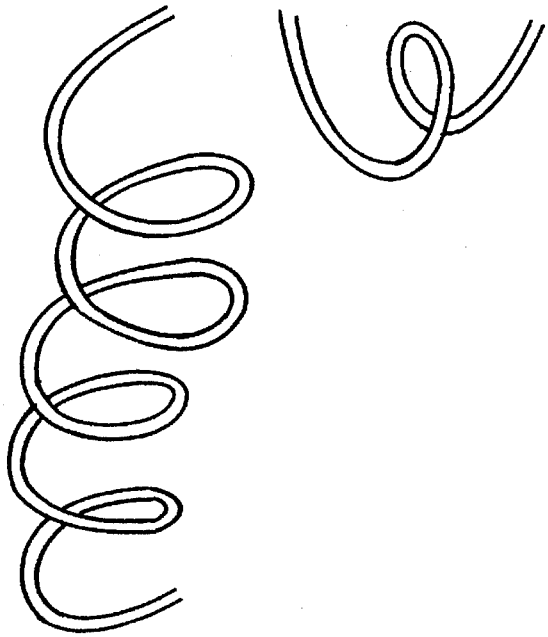
FIGS. 2, 4, 6 and 8 illustrate magnified views of bicomponent spunbond fibers that contain the high melt flow rate propylene polymer of the present invention.
Figure 3:
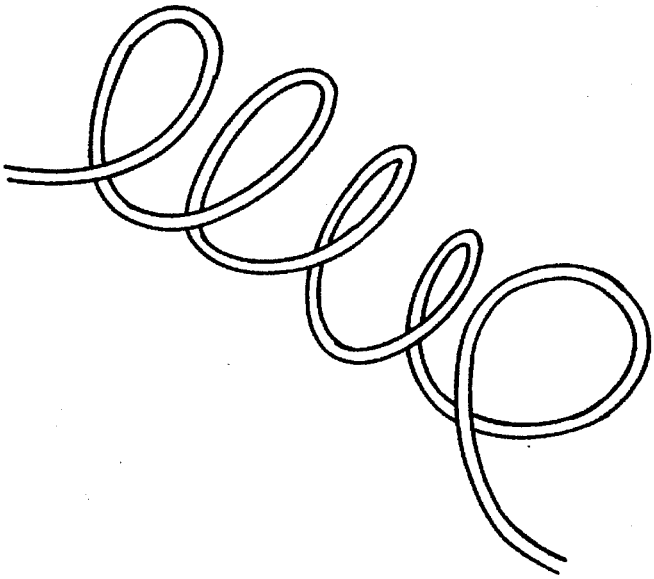
FIGS. 3, 5, 7 and 9 illustrate magnified views of bicomponent spunbond fibers that contain a conventional propylene polymer for spunbond fibers.
Figure 4:
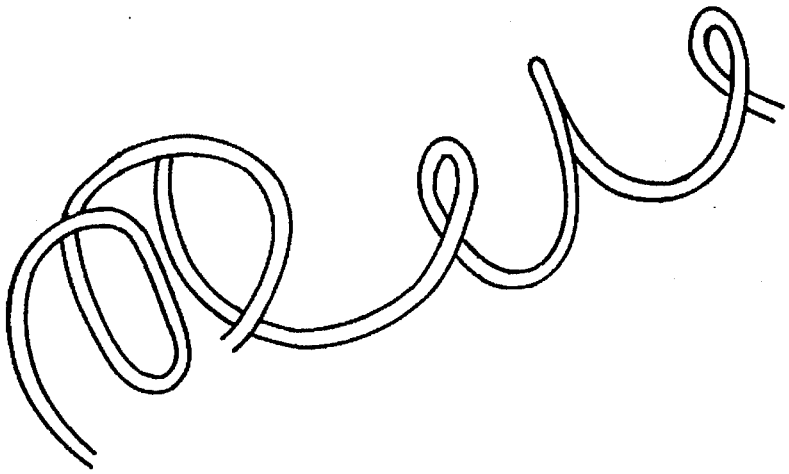
Figure 5:
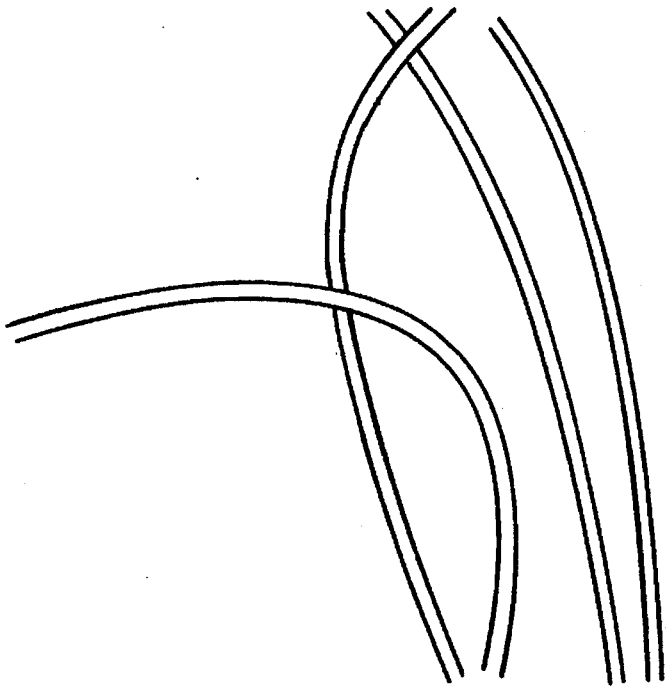
Figure 6:
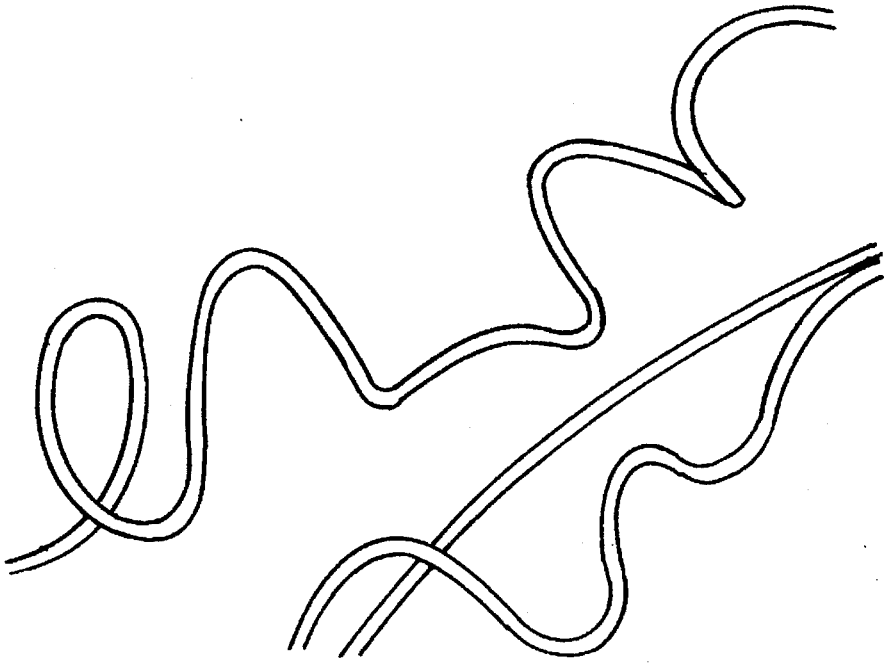
Figure 7:
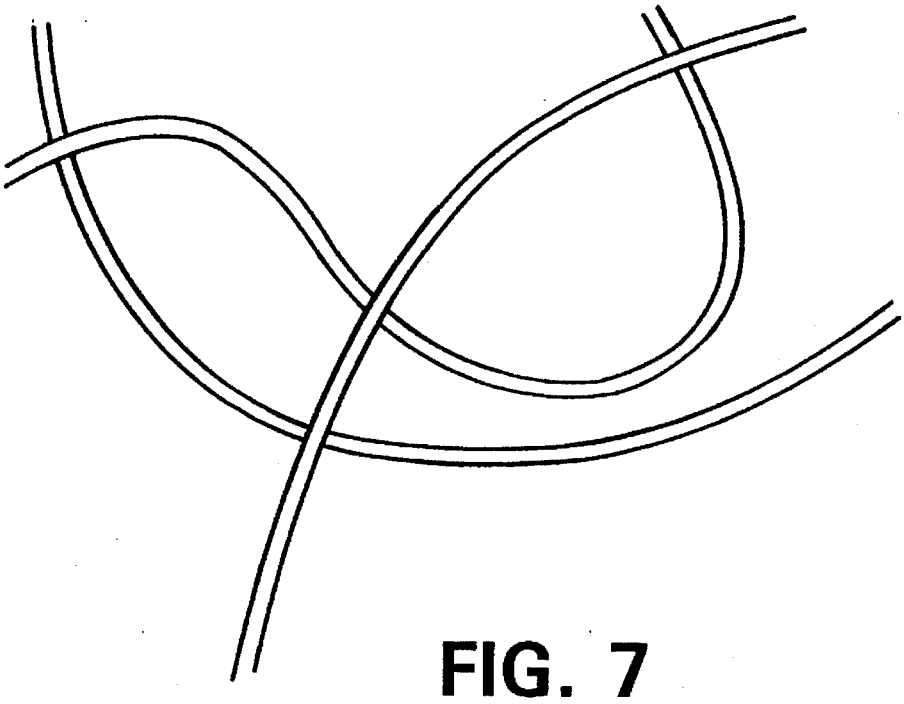
Figure 8:
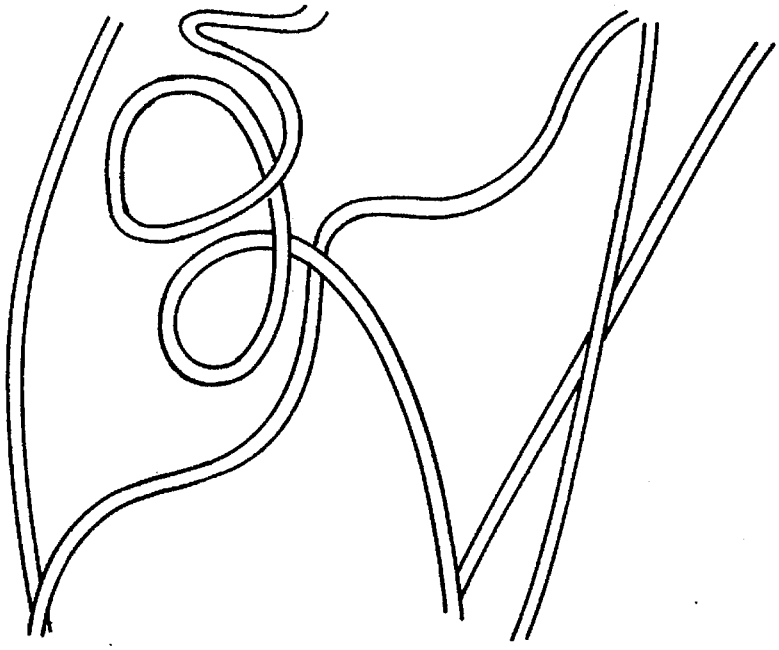
Figure 9:
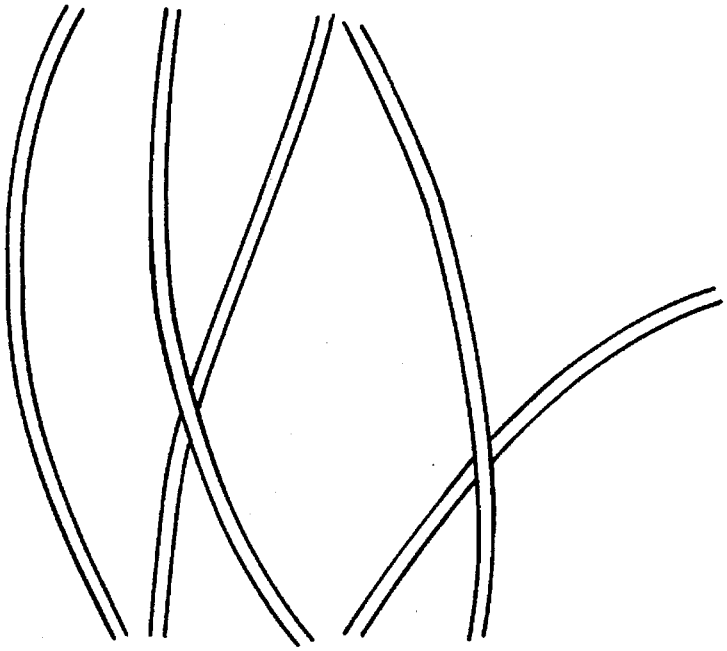

| Example | Air Pressure (psi) | Air Pressure (kPa) | Fiber Size (den) | Fiber Size (dtex) | Illustration |
|---|---|---|---|---|---|
| Ex8 | 3 | 21 | 3.0 | 3.3 | FIG. 2 |
| C6 | 3 | 21 | 3.2 | 3.6 | FIG. 3 |
| Ex9 | 4 | 28 | 2.5 | 2.8 | FIG. 4 |
| C7 | 4 | 28 | 2.8 | 3.1 | FIG. 5 |
| Ex10 | 5 | 34 | 2.5 | 2.8 | FIG. 6 |
| C8 | 5 | 34 | 2.6 | 2.9 | FIG. 7 |
| Ex11 | 6 | 41 | 2.2 | 2.4 | FIG. 8 |
| C9 | 6 | 41 | 2.6 | 2.9 | FIG. 9 |

FIGS. 2 and 3 illustrate that the 3 denier conjugate fibers had similar levels of crimps, indicating that both the conventional polypropylene for spunbond fibers and the high melt flow rate polypropylene are suitable for producing crimped conjugate fibers having large diameters. FIGS. 4–7 demonstrate that the conjugate fibers containing the conventional polypropylene do not have crimps whereas the conjugate fibers containing the high melt flow rate polypropylene largely retained the level of crimps exhibited by the 3 denier fibers. FIGS. 8 and 9 demonstrate that the conjugate fibers containing the high melt flow rate polypropylene retained some of the crimps even when fine fibers are produced whereas the conjugate fibers containing the conventional polypropylene no longer have any crimp.

FIGS. 2–9 demonstrate that conjugate fibers containing the high melt flow rate polypropylene of the present invention provide highly crimpable or crimped conjugate fibers even at low deniers in which conventional conjugate fibers do not form crimps.

Example 12 (Ex12)

Example 4 was repeated except different pressures of aspirating air were used as indicated in Table 4 to produce conjugate spunbond fibers having different average sizes. The results are shown in Table 4. Table 4 also contains the results of Examples 4 and 7 and Comparative Examples 3–5 for comparison purposes.

Examples 13–15 (Ex13–Ex15)

Example 12 was repeated except the spinning pack was kept at a higher temperature, 232° C., and different aspirating air pressures were used as indicated in Table 4. The results are shown in Table 4.

Comparative Examples 10–12 (C10–C12)

Comparative Example 3 was repeated except the spinning pack was kept at a higher temperature, 232° C., and different aspirating air pressures were used as indicated in Table 4. The results are shown in Table 4.

TABLE 4

| Example | PP MFR (g/10 min) | Pack Temp. (°C.) | Aspirating Air Pressure (psi) | Aspirating Air Pressure (kPa) | Fiber Size (den) | Fiber Size (dtex) | Web Weight (osy) | Web Weight ($g/m^2$) | Bulk (mil/osy) | Bulk ($mm/g/m^2$) |
|---|---|---|---|---|---|---|---|---|---|---|
| Ex4 | 65 | 221 | 4 | 28 | 2.5 | 2.8 | 1.85 | 63 | 37.2 | 0.0279 |
| Ex7 | 65 | 221 | 6 | 41 | 1.9 | 2.1 | 2.18 | 74 | 23.6 | 0.0177 |
| Ex12 | 65 | 221 | 8 | 55 | 1.8 | 2.0 | 2.1 | 71 | 14.3 | 0.0107 |
| C3 | 35 | 221 | 4 | 28 | 2.5 | 2.8 | 1.95 | 66 | 19.5 | 0.0146 |
| C4 | 35 | 221 | 5 | 34 | 2.2 | 2.4 | 2.03 | 69 | 14.5 | 0.0109 |
| C5 | 35 | 221 | 5.5 | 38 | 2.0 | 2.2 | 2.12 | 72 | 14.3 | 0.0107 |
| Ex13 | 65 | 232 | 4 | 28 | 2.3 | 2.6 | 1.8 | 61 | 30.0 | 0.0225 |
| Ex14 | 65 | 232 | 6 | 41 | 1.9 | 2.1 | 1.9 | 64 | 34.7 | 0.0260 |
| Ex15 | 65 | 232 | 10 | 69 | 1.7 | 1.9 | 2.2 | 75 | 20.5 | 0.0154 |
| c10 | 35 | 232 | 4 | 28 | 2.5 | 2.8 | 1.9 | 64 | 27.9 | 0.0209 |
| C11 | 35 | 232 | 6 | 41 | 1.9 | 2.1 | 2.2 | 75 | 13.6 | 0.0102 |
| C12 | 35 | 232 | 8 | 55 | 1.8 | 2.0 | 2.3 | 78 | 14.3 | 0.0107 |

Figure 10:
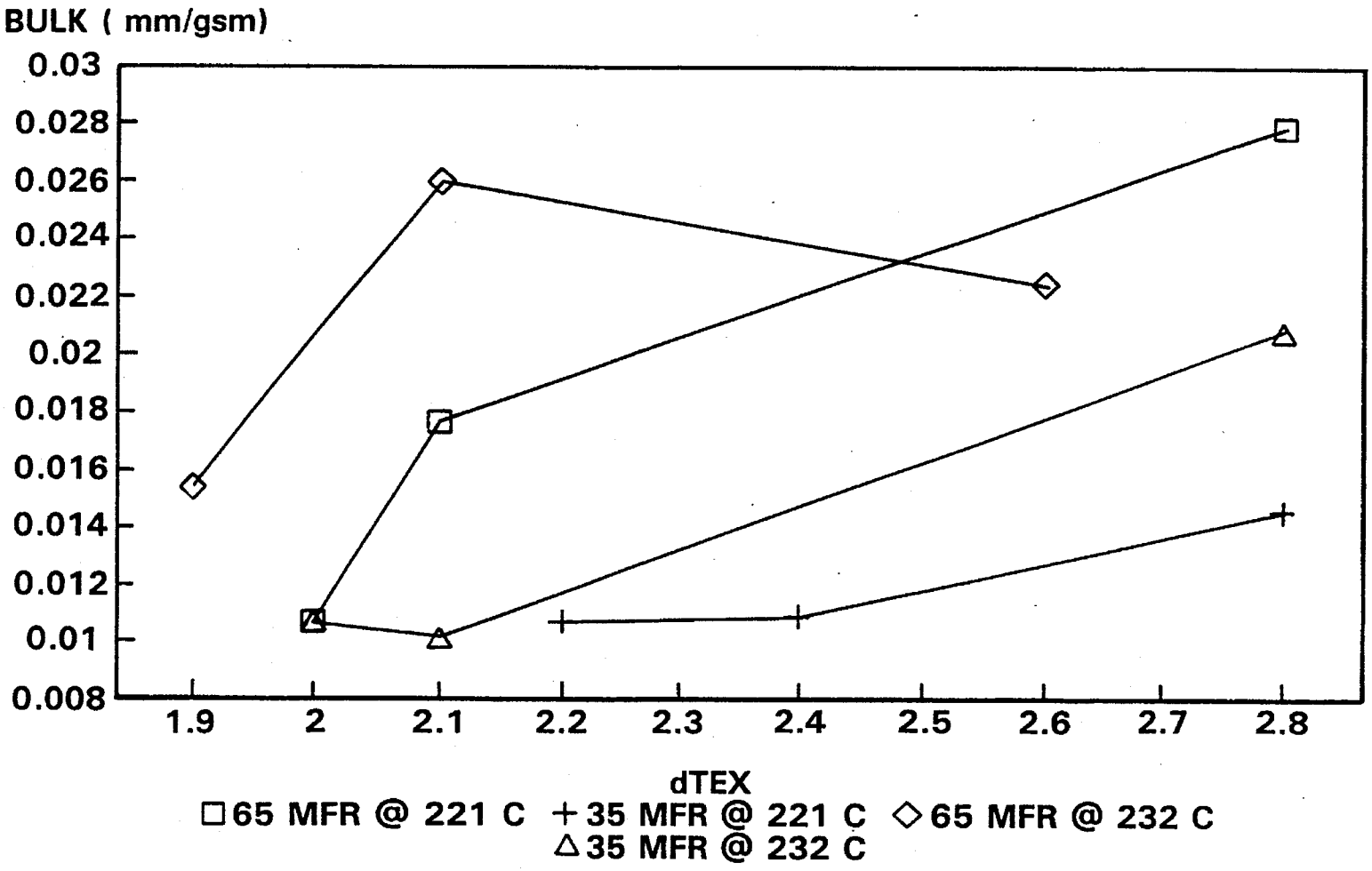
FIG. 10 graphically illustrates the bulk difference resulting from utilizing conventional and high melt flow rate propylene polymers.

The fiber size and bulk values of the examples in Table 4 are graphically illustrated in FIG. 10. The fiber size and bulk values are organized into four groups in accordance with the melt flow rate of the polymer and the spinning pack temperature. The above results and FIG. 10 clearly demonstrate that the conjugate spunbond fibers containing the high melt flow rate propylene polymer produce lofty nonwoven fabrics even when the fiber size is reduced to the levels in which the conventional 35 melt flow rate polypropylene only produces flat nonwoven webs (i.e., smaller than about 2.5 denier or 2.8 dtex). This improved result in bulk indicates that fine conjugate spunbond fibers containing the high melt flow rate propylene polymers of the present invention retain crimps even when similarly produced and similarly sized conjugate spunbond fibers containing conventional propylene polymers for spunbond fibers no longer retain crimps. In addition, as can be seen from FIG. 10, the high melt flow rate propylene polymer of the present invention can be processed to produce highly crimped conjugate spunbond fibers at a lower processing temperature than conventional propylene polymers for spunbond fibers.

The conjugate spunbond fibers containing the high melt flow rate propylene polymer of the present invention provide high levels of crimps even at fine deniers and can be fabricated into lofty, low-density nonwoven webs of fine denier fibers even at high production rates. Additionally, the high melt flow rate propylene polymer can be melt-processed at a lower temperature than conventional propylene polymers for spunbond fibers, significantly abating the problems associated with the melt-extruding and quenching steps of the spunbond fiber production process, e.g., thermal degradation of polymers and roping of the spun fibers.

What is claimed is:

1. A lofty nonwoven fabric having a bulk of at least about 20 mils/osy and comprising crimped conjugate spunbond fibers, said conjugate spunbond fibers having a weight per unit length equal to or less than about 2.5 denier and comprising:

a propylene polymer component, wherein said propylene polymer component comprises a propylene polymer having a melt flow rate between about 50 g/10 min. and 200 g/10 min. as measured in accordance with ASTM D1238, Testing Condition 230/2.16 and is selected from homopolymers and copolymers of propylene and blends thereof, and an ethylene polymer component, wherein said ethylene polymer component comprises an ethylene polymer which is selected from homopolymers and copolymers of ethylene, wherein each of said components occupies a distinct section for substantially the entire length of said spunbond fiber.

2. The lofty nonwoven fabric of claim 1 wherein said propylene polymer is selected from the group consisting of isotactic polypropylene and propylene copolymers containing up to about 10 wt % of ethylene.

3. The lofty nonwoven fabric of claim 1 wherein said conjugate fiber has a side-by-side configuration.

4. The lofty nonwoven fabric of claim 1 wherein said conjugate fiber has an eccentric sheath-core configuration.

5. The lofty nonwoven fabric of claim 1 wherein said propylene polymer has a melt flow rate between about 55 and about 150 g/10 min.

6. The lofty nonwoven fabric of claim 1 wherein said propylene polymer is isotactic polypropylene and said ethylene polymer is linear low density polyethylene.

7. A disposable article comprising the lofty nonwoven fabric of claim 1.

8. A personal care article comprising the lofty nonwoven fabric of claim 1.

9. A disposable gown comprising the lofty nonwoven fabric of claim 1.

10. A filter comprising the lofty nonwoven fabric of claim 1.

* * * * *